US007275595B2

(12) United States Patent
Tocalino et al.

(10) Patent No.: US 7,275,595 B2
(45) Date of Patent: Oct. 2, 2007

(54) METHOD AND APPARATUS TO ISOLATE FLUIDS DURING GRAVEL PACK OPERATIONS

(75) Inventors: Samuel Tocalino, Houston, TX (US); Mehmet Parlar, Houston, TX (US); Gerard Daccord, Vauhallan (FR); Jean Desroches, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 417 days.

(21) Appl. No.: 10/709,554

(22) Filed: May 13, 2004

(65) Prior Publication Data

US 2005/0252657 A1 Nov. 17, 2005

(51) Int. Cl.
*E21B 43/04* (2006.01)

(52) U.S. Cl. ..... 166/278; 166/51; 166/291; 166/155; 166/156

(58) Field of Classification Search ..... 166/278, 166/51, 291, 155, 156
See application file for complete search history.

(56) References Cited

U.S. PATENT DOCUMENTS 3,464,493 A * 9/1969 Chancellor et al. ..... 166/285
4,424,864 A 1/1984 Logan
4,577,689 A * 3/1986 Dotson ..... 166/250
4,646,839 A * 3/1987 Rickey ..... 166/335
5,082,052 A 1/1992 Jones et al.
5,090,478 A 2/1992 Summers
5,419,394 A 5/1995 Jones
5,433,270 A * 7/1995 LaFleur ..... 166/152
5,623,993 A 4/1997 Van Buskirk et al.
5,746,274 A 5/1998 Voll et al.
6,095,245 A 8/2000 Mount
6,176,307 B1 1/2001 Danos et al.
6,510,896 B2 1/2003 Bode et al.
6,571,880 B1 6/2003 Butterfield, Jr. et al.
6,601,648 B2 8/2003 Ebinger
6,951,246 B2 * 10/2005 Tessier et al. ..... 166/153
2004/0194959 A1 10/2004 Chang et al.

* cited by examiner

*Primary Examiner*—David Bagnell
*Assistant Examiner*—Brad Harcourt
(74) *Attorney, Agent, or Firm*—Van Someren, PC; Bryan P. Galloway

(57) ABSTRACT

The present invention provides for an apparatus and method to displace fluids and to prevent the mixing or bypassing of fluids used in gravel pack operations. A moveable plug is used to create a physical partition between fluids.

10 Claims, 2 Drawing Sheets

METHOD AND APPARATUS TO ISOLATE FLUIDS DURING GRAVEL PACK OPERATIONS

BACKGROUND OF INVENTION

1. Field of Invention

The present invention pertains to the pumping of fluids into a wellbore, and particularly to the pumping of fluids during a gravel pack operation.

2. Related Art

It is often desired to place sand or other filtering medium between a sand screen and the wellbore in wells having poorly or loosely consolidated production formations. Without the presence of such filtering media, screens can become plugged or production equipment can be damaged by fines (small particulates of the formation matrix) or formation sand produced with the production fluids.

The sand is typically conveyed entrained in a fluid. The entrained sand is generally referred to as "gravel" and the gravel and conveyance fluid combination is generally referred to as a "gravel slurry." The gravel slurry is normally pumped into the well through tubing until it reaches a crossover, at which point the slurry enters the annulus between the sand screen and the wellbore or casing. As the conveyance fluid is either lost to the formation or returns to the surface, the gravel settles out, packing the annulus.

A gravel pack operation usually requires the pumping of more than one type of fluid. The volume of gravel slurry pumped is generally calculated based on the anticipated volume necessary to fill the annular space with gravel. Spacer fluids are generally placed ahead of and behind the gravel slurry to provide for fluid isolation and separation during the gravel pack operation. Other fluids, such as brine or drilling fluid "mud", may be pumped behind the gravel slurry as displacement fluid to force the gravel slurry into the proper location in the well. Thus, different fluids may be present or introduced into the well both ahead of and behind the gravel slurry.

Because the different fluids have different physical properties, such as density and viscosity, they can sometimes mix, or one fluid may flow past the other. Those undesired effects may be exacerbated in horizontal or highly deviated portions of the wellbore or if fluids are traveling down the wellbore at low velocities. That may lead to a reduction in displacement efficiency, preventing a particular fluid from reaching its intended location in the well. That, in turn, may lead to an incomplete gravel pack operation.

SUMMARY OF INVENTION

The present invention provides for an apparatus and method to displace fluids and to prevent the mixing or bypassing of fluids used in gravel pack operations. A moveable plug is used to create a physical partition between fluids.

Advantages and other features of the invention will become apparent from the following description, drawings, and claims.

DETAILED DESCRIPTION

Figure 1A:
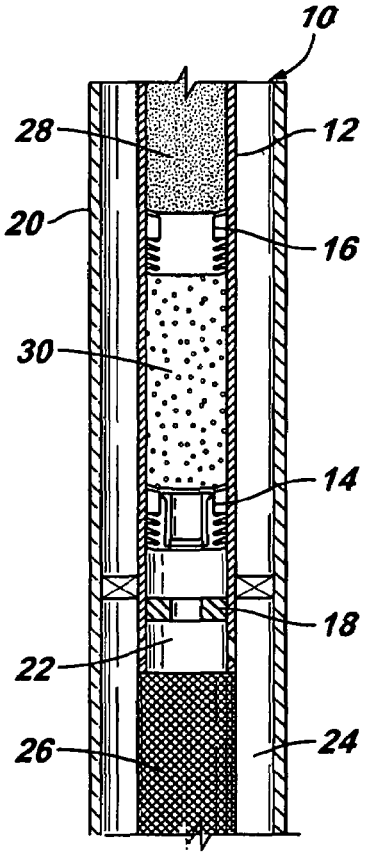
FIGS. 1A, 1B, and 1C are schematic views of a fluid displacement system constructed in accordance with the present invention showing different stages of operation.
Figure 1B:
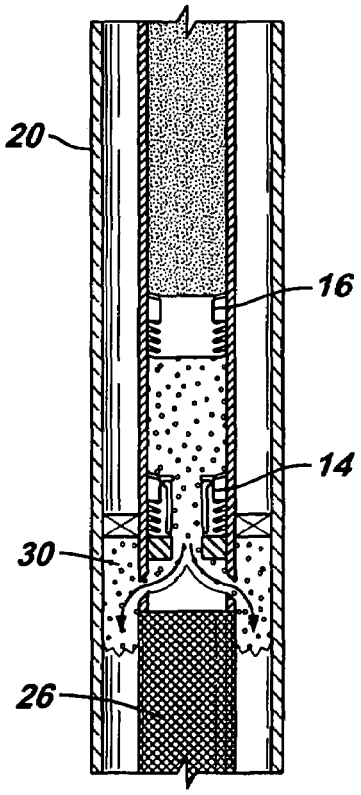
Figure 1C:
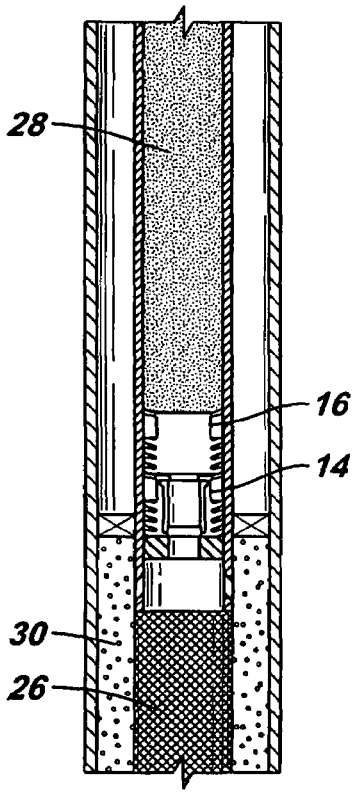

Referring to FIGS. 1A, 1B, and 1C, a fluid displacement system 10 comprises a work string 12, a bottom plug 14, a top plug 16, and a plug catcher 18. In some embodiments, there may be no bottom plug 14.

Work string 12 is a tubular member extending from the surface to some desired depth in a wellbore 20. Typically work string 12 terminates in a crossover tool or service tool 22 so that fluid pumped through work string 12 exits into an annulus 24 between wellbore 20 (or casing, if present) and a sand screen 26. Work string 12 may be used to convey various fluids such as brine or drilling mud 28 and gravel slurry 30.

Figure 2A:
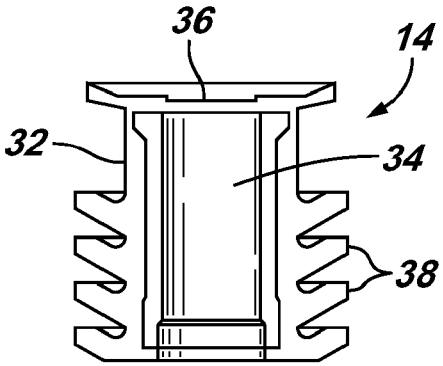
FIGS. 2A and 2B are schematic views of a plug used in the fluid displacement system of FIGS. 1A 1C.
Figure 2B:
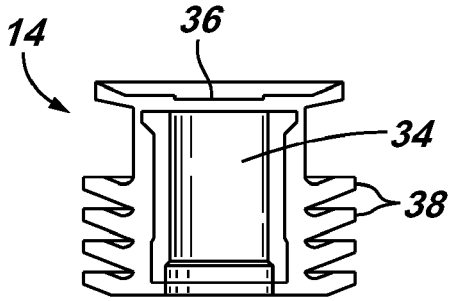

Bottom plug 14, as shown in FIGS. 2A and 2B, comprises a plug body 32, having a central passageway 34 therethrough, and a diaphragm 36, pre-set to rupture at a desired pressure differential, extending across passageway 34. Diaphragm 36 sealingly engages plug body 32 and prevents flow through passageway 34 until diaphragm 36 is ruptured or otherwise removed. Bottom plug 14 can be made of various materials but is preferably made of slightly compressible material to enhance its ability to seal against the inner diameter of work string 12 (bottom plug 14 is shown compressed in FIG. 2B). Plug body 32 may also comprise ribs 38. Ribs 38 are preferably tapered and slightly compressible to further enhance the sealability of bottom plug 14.

Top plug 16 is shown in FIGS. 1A-1C. Top plug 16 comprises the plug body 32 and is very similar and may be identical to bottom plug 14, with a central passageway 34 therethrough and a diaphragm 36. As in bottom plug 14, diaphragm 36 is pre-set to rupture at a certain pressure differential. The rupture pressure for top plug 16 is preferably greater than that of bottom plug 14, though they could be equal. Top plug 16 can also be made of various materials, but is preferably made of slightly compressible material to enhance its ability to seal against the inner diameter of work string 12. Plug body 32 may also comprise ribs 38. As above with bottom plug 14, ribs 38 on plug body 32 are preferably tapered and slightly compressible to further enhance the sealability of top plug 16.

Central passageway 34 through both top and bottom plugs 16, 14 provides an inner diameter, after rupture of central diaphragm 36, large enough to allow the passage of balls, bars, and other tools necessary to operate a downhole tool. Central passageway 34 is also designed to pose minimum or preferably no interference with down-hole tools. Rupture of diaphragm 36 is designed to leave no debris or cause any restriction.

Figure 3:
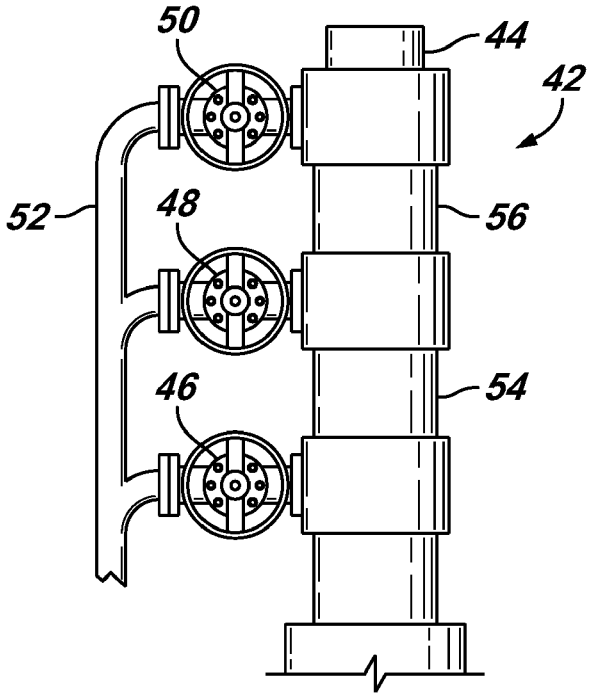
FIG. 3 is a perspective view of a plug head used in the fluid displacement system of FIGS. 1A 1C.

FIG. 3 shows a plug head 42. Plug head 42 is placed at or near the surface of the well and attaches to the upper end of work string 12. Plug head 42 comprises a housing 44, valves 46, 48, and 50, and an injection pipe 52. Housing 44 has spacer pipes 54 and 56 to spatially separate valves 46, 48, and 50. In one embodiment bottom plug 14 resides in spacer pipe 54 and top plug 16 resides in spacer pipe 56. Plugs 14 and 16 may be held in place in their respective spacer pipes by pins (not shown) or other fastener means. Alternatively, plug head 42 may be similar to the plug launching tool described in U.S. Pat. No. 5,890,537, the description and illustrations of which are incorporated herein for all purposes. Other variations of plug heads 42 may also be suitable to deploy plugs 14, 16.

In operation, work string 12, with crossover 22 and sand screen 26, is run into the well until screen 26 is properly positioned. Brine 28 is commonly circulated in wellbore 20 after positioning of screen 26. Brine 28 can be pumped through injection pipe 52 through open valve 46 (with valves 48 and 50 closed). Brine 28 passes below bottom plug 14 into the lower portion of plug head 42.

When the operator wishes to pump gravel slurry 30, he or she closes valve 46, opens valve 48 (keeping valve 50 closed), and pumps slurry 30 into injection pipe 52. Slurry 30 enters plug head 42 just above bottom plug 14. Bottom plug 14 is released to flow into work string 12 when the pins or other fastening means shear or are removed from housing 44. Pressure applied to slurry 30 forces bottom plug 14 downward, displacing brine 28 as bottom plug 14 descends.

After pumping the desired volume of slurry 30, the operator can resume pumping brine 28, but before doing so, he or she will close valve 48 and open valve 50 (keeping valve 46 closed). That directs brine 28, being pumped into injection pipe 52, into plug head 42 just above top plug 16. Once the pins or fastening means holding top plug 16 in spacer 56 are removed or sheared, top plug 16 will move downward into work string 12, displacing slurry 30 and bottom plug 14 as it moves. Both bottom plug 14 and top plug 16 effectively seal against the inner diameter of work string 12 to isolate the fluids above, between, and below plugs 14, 16.

As brine 28 is pumped, top plug 16, slurry 30, and bottom plug 14 continue to move downward into wellbore 20 until bottom plug 14 comes into abutting contact with plug catcher 18. Plug catcher 18 is an internal profile in work string 12 that prevents further downward motion of bottom plug 14. As brine 28 continues to be pumped, pressure builds rapidly above diaphragm 36 due to the generally incompressible nature of the fluids involved. Upon sufficient pressure, diaphragm 36 ruptures, allowing slurry 30 to exit crossover 22 and enter its desired position in annulus 24. Top plug 16, being pushed from above by brine 28, pushes slurry 30 from work string 12 until top plug 16 comes into abutting contact with bottom plug 14. Similarly, upon reaching the necessary pressure, diaphragm 36 in top plug 16 ruptures, allowing the fluids to continue traveling down work string 12 and out to the wellbore. A pressure indication can be observed at the surface each time diaphragm 36 in either one of the plugs 14, 16 ruptures.

Work string 12 can then be removed from the well, along with plugs 14, 16, plug catcher 18, and crossover 22. Sand screen 26, left in the hole packed in gravel, can then be connected to production tubing (not shown) to produce the desired well fluids.

The above-described operation can be performed using only plug 14 or plug 16, if desired.

In the preceding description, directional terms, such as "upper," "lower," "vertical," "horizontal," etc., may have been used for reasons of convenience to describe an apparatus and its associated components. However, such orientations are not needed to practice the invention, and thus, other orientations are possible in other embodiments of the invention.

Although only a few example embodiments of the present invention are described in detail above, those skilled in the art will readily appreciate that many modifications are possible in the example embodiments without materially departing from the novel teachings and advantages of this invention. Accordingly, all such modifications are intended to be included within the scope of this invention as defined in the following claims. It is the express intention of the applicant not to invoke 35 U.S.C. § 112, paragraph 6 for any limitations of any of the claims herein, except for those in which the claim expressly uses the words 'means for' together with an associated function.

The invention claimed is:

1. A fluid isolation system for use in gravel pack operations in a subterranean well comprising:

a work string having an inner wall;

a lower plug that can move within the work string while sealingly engaged to the inner wall of the work string, wherein the lower plug has a lower frangible diaphragm covering a central passageway through the lower plug;

an upper plug that can move within the work string while sealingly engaged to the inner wall of the work string; wherein the upper plug has an upper frangible diaphragm covering a central passageway through the upper plug;

a plug catcher mounted to the work string at some desired location in the well; and a crossover mounted to the work string below the plug catcher;

in which the fluid between the lower plug and the upper plug is isolated from the fluid above the upper plug and below the lower plug.

2. The fluid isolation system of claim 1 in which the fluid between the lower plug and the upper plug is slurry and the fluid above the upper plug is brine or drilling fluid.

3. The fluid isolation system of claim 1 further comprising a plug head in which the upper and lower plugs initially reside.

4. The fluid isolation system of claim 3 in which the plug head further comprises an injection pipe and a plurality of valves.

5. The fluid isolation system of claim 1 in which the plug catcher is an internal profile in the work string to prevent further downward motion of the lower plug.

6. The fluid isolation system of claim 1 in which the lower frangible diaphragm, upon the lower plug being restrained from further downward movement by the plug catcher, ruptures due to applied fluid pressure.

7. The fluid isolation system of claim 6 in which the upper plug continues to travel downward after the lower plug is restrained by the plug catcher, forcing the fluid below the upper plug to exit the work string through the crossover.

8. The fluid isolation system of claim 1 in which the upper frangible diaphragm, upon the upper plug being restrained from further downward movement by the lower plug, ruptures due to applied fluid pressure from above.

9. A method to isolate fluids during a gravel pack operation in a subterranean well comprising:

running a work string having a plug catcher and a crossover into the well;

placing a bottom plug having a lower frangible diaphragm covering a central passageway in the bottom plug into the work string;

pumping slurry into the work string above the bottom plug;

placing a top plug having an upper frangible diaphragm covering a central passageway in the top plug into the work string;

pumping fluid into the work string above the top plug;

displacing the top plug and the bottom plug until the bottom plug encounters the plug catcher;

further displacing the top plug until it encounters the bottom plug, the applied fluid pressure bursting the lower frangible diaphragm;

passing the slurry through the central passageway and out of the work string through the crossover; and further applying fluid pressure to burst the upper frangible diaphragm.

10. The method of claim 9 in which the work string includes a detachable sand screen below the crossover and the method further comprises releasing the sand screen from the work string and retrieving the work string.

* * * * *